US007431098B2

(12) United States Patent
Ohmer et al.

(10) Patent No.: US 7,431,098 B2
(45) Date of Patent: Oct. 7, 2008

(54) SYSTEM AND METHOD FOR ISOLATING A WELLBORE REGION

(75) Inventors: Herve Ohmer, Houston, TX (US); Klaus B. Huber, Sugar Land, TX (US)

(73) Assignee: Schlumberger Technology Corporation, SugarLand, TX (US)

( * ) Notice: Subject to any disclaimer, the term of this patent is extended or adjusted under 35 U.S.C. 154(b) by 191 days.

(21) Appl. No.: 11/306,652

(22) Filed: Jan. 5, 2006

(65) Prior Publication Data

US 2007/0151724 A1 Jul. 5, 2007

(51) Int. Cl.
*E21B 33/12* (2006.01)

(52) U.S. Cl. ..... 166/387; 166/179

(58) Field of Classification Search ..... 166/387, 166/179, 191; 277/934
See application file for complete search history.

(56) References Cited

U.S. PATENT DOCUMENTS

| | | | | |
|---|---|---|---|---|
| 2,849,070 | A * | 8/1958 | Maly | 277/336 |
| 2,945,541 | A * | 7/1960 | Maly et al. | 166/185 |
| 5,868,200 | A | 2/1999 | Bryant et al. | |
| 6,298,916 | B1 | 10/2001 | Tibbles et al. | |
| 6,620,254 | B2 | 9/2003 | Zaech et al. | |
| 2003/0057323 | A1 | 3/2003 | Keogh | |
| 2003/0089496 | A1 | 5/2003 | Price-Smith et al. | |
| 2005/0199401 | A1 * | 9/2005 | Patel et al. | 166/387 |

FOREIGN PATENT DOCUMENTS

WO WO 2004/057715 * 7/2004

OTHER PUBLICATIONS

Al-Anazi, Hamoud A., Sharma, Mukul M.; Evaluation of a pH-Sensitive Polymer for Gravel-Packing Operations; SPE Production and Operations Symposium; Oklahoma City, OK; Mar. 24-27, 2001; SPE 67292; Society of Petroleum Engineers Inc., Richmond, TX.

Al-Anazi, Hamoud A., Sharma, Mukul M.; Use of a pH-Sensitive Polymer for Conformance Control; SPE International Symposium and Exhibition on Formation Damage Control; Lafayette, LA; Feb. 20-21, 2002; SPE 73782; Society of Petroleum Engineers Inc., Richmond, TX.

Al-Anazi, Hamoud A., Sharma, Mukul M.; Evaluation of a pH-Sensitive Polymer for Gravel-Packing Operations; Revised manuscript (of SPE 67292); SPE 76813 revised Jan. 2, 2002; Society of Petroleum Engineers Inc., Richmond, TX.

* cited by examiner

*Primary Examiner*—William P Neuder
(74) *Attorney, Agent, or Firm*—Bryan P. Galloway; Jeremy P. Welch; Robert VanSomeren

(57) ABSTRACT

A technique is provided to isolate regions of a wellbore. The technique utilizes a swellable material packer that comprises a layer of swellable material disposed about a tubular member of a completion. When the layer is exposed to a substance that induces swelling of the swellable material, the layer expands between the tubular and a surrounding wall to isolate a region of the wellbore annulus.

24 Claims, 7 Drawing Sheets

SYSTEM AND METHOD FOR ISOLATING A WELLBORE REGION

BACKGROUND

Various subterranean formations contain hydrocarbon based fluids that can be produced to a surface location for collection. Generally, a wellbore is drilled, and a completion is moved downhole to facilitate production of desired fluids from the surrounding formation. In many applications, however, it is desirable to isolate regions of the wellbore from adjacent regions during certain procedures, e.g. production of well fluid, injection procedures, or other procedures.

A device commonly used to isolate regions of the wellbore is a packer. The packer is mounted in a wellbore completion, typically along the exterior of a tubing, and the packer can be actuated to seal off flow in the annulus between the tubing and a surrounding wall of the wellbore. The surrounding wall may be the wall of an open borehole, or the surrounding wall may be a wellbore casing or liner.

Packers use a seal element that is moved radially outward into sealing engagement with the surrounding wall. Typically, a mechanical actuator is used to move the seal element and thereby isolate one region of the wellbore from another. The mechanical actuation can be achieved by a mechanical linkage or by inflation of the seal element.

SUMMARY

In general, the present invention provides a system and method for utilizing swellable packers used in isolating regions of a wellbore. A wellbore completion is designed for deployment in a wellbore and comprises one or more packers. Each packer utilizes a layer of swellable material, such as a swellable elastomer, disposed around a tubular of the completion. The layer of swellable material can be actuated by a specific substance or substances that cause the swellable material to swell, i.e. expand, until the region between the tubular and the surrounding wall is filled.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to isolating regions within wellbore. Generally, a completion is deployed within a wellbore drilled in a formation containing desirable production fluids. The completion can be used, for example, for the production of hydrocarbon based fluids, e.g. oil. In many applications, regions of the wellbore are isolated by isolation devices, such as packers, that are moved downhole in cooperation with the completion. The type of completion, arrangement of completion components, number of packers, and other design considerations can vary from one application to another.

Figure 1:
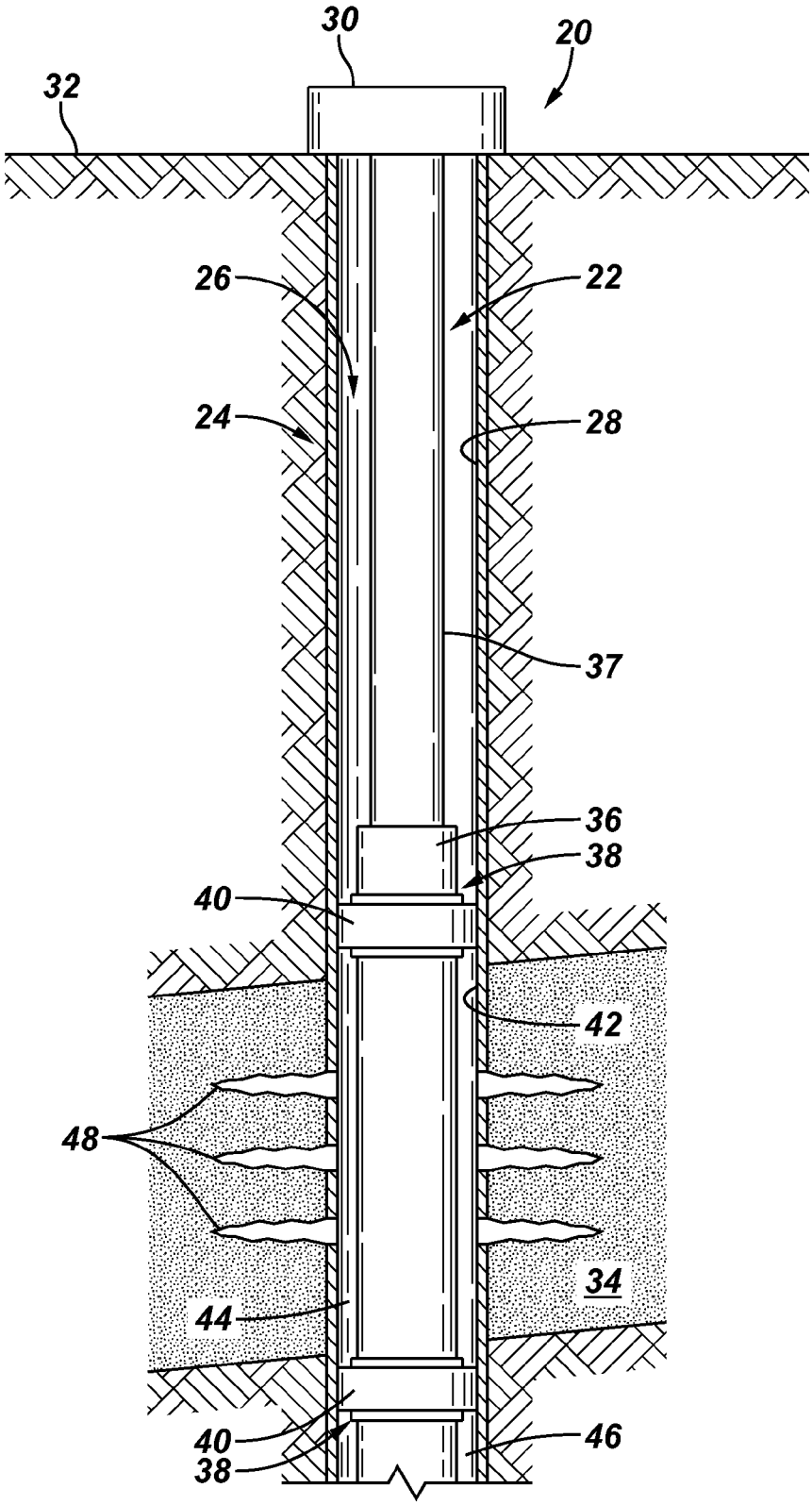
FIG. 1 is a front elevation view of a completion deployed in wellbore, according to an embodiment of the present invention.

Referring generally to FIG. 1, a well system 20 is illustrated as comprising a completion 22 deployed for use in a well 24 having a wellbore 26 lined with a wellbore casing 28. Completion 22 extends downwardly from a wellhead 30 disposed at a surface location 32, such as the surface of the Earth or a seabed floor. Wellbore 26 is formed, e.g. drilled, in a formation 34 that may contain, for example, desirable fluids, such as oil or gas. Completion 22 is located within the interior of casing 28 and comprises a tubular 36 about which one or more wellbore isolation devices 38, often referred to as packers, are disposed. The completion 22 also may rely on a tubing 37, such as a production tubing or coiled tubing, extending into the wellbore 26 from wellhead 30. Tubing 37 may be used as a conduit for carrying produced fluids, e.g. oil, through the wellbore to a desired collection location.

Each packer 38 comprises a sealing element 40 that seals off the region of wellbore 26 between tubular 36 and a surrounding wall 42. Surrounding wall 42 can be, for example, the inside of casing 28 or the wall of an open hole wellbore. In many applications, packers 38 seal off the annulus between the completion and the surrounding wall. Accordingly, the packers can be used to isolate regions of the well, such as regions 44 and 46. If the packers 38 are expanded within casing 28, perforations 48 often are formed through the casing to enable the flow of fluids between formation 34 and wellbore 26.

Figure 2:
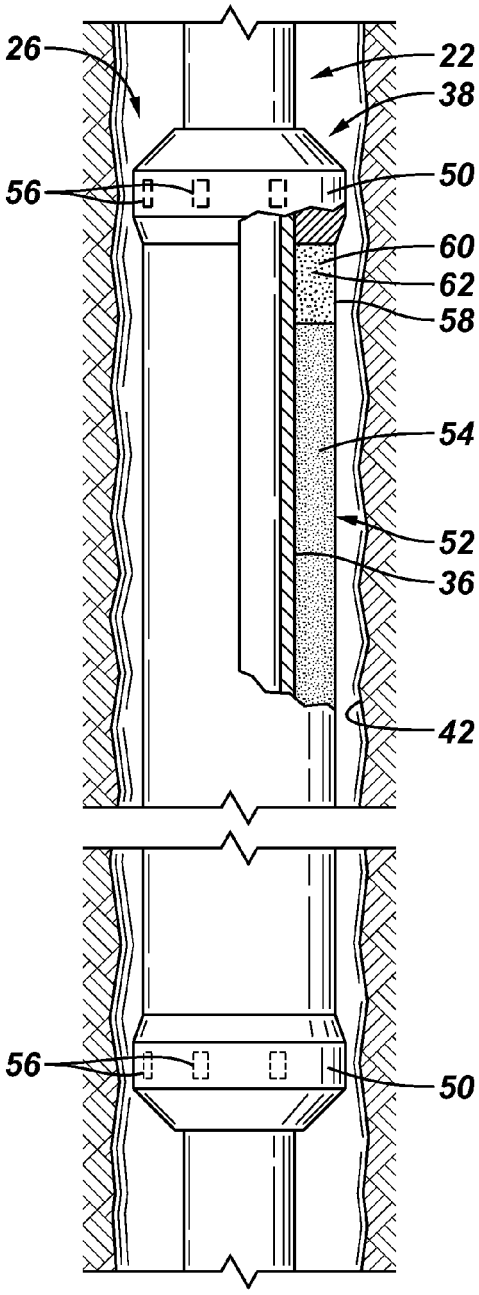
FIG. 2 is front elevation view, with a partial cut-away portion, of a packer having a swellable material, according to an embodiment of the present invention.

Referring now to FIG. 2, an embodiment of a packer 38 is illustrated. In this embodiment, packer 38 is mounted on tubular 36 and comprises a pair of flanges 50 secured to tubular 36. The flanges 50 may be secured in place by, for example, welding, threading or swaging. A layer 52 of a swellable material 54 is disposed around tubular 36 axially between flanges 50. The flanges 50 provide protection for the swellable material 54 while running completion 22 in hole, especially when the wellbore is highly deviated or horizontal. Additionally, flanges 50 facilitate running within the wellbore by minimizing friction. In fact, rollers 56 can be incorporated into flanges 50 to further reduce friction during movement of completion 22 along wellbore 26.

In the embodiment illustrated, the layer 52 of swellable material 54 has a substantially uniform thickness. In one embodiment, the layer 52 may be molded around tubular 36 along the portion of the tubular axially limited by flanges 50. Effectively, flanges 50 constrain expansion of swellable material 54 in an axial direction while enabling radial expansion to create a seal in the wellbore 26.

Figure 3:
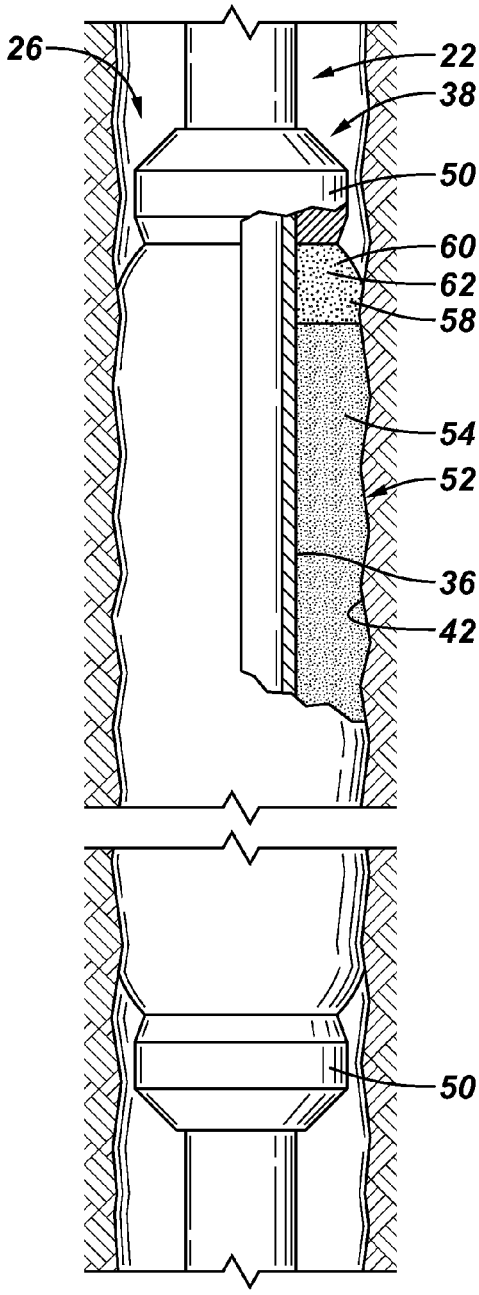
FIG. 3 is a view similar to that in FIG. 2, but showing the swellable material in an expanded or swollen state, according to an embodiment of the present invention.

According to one design, packer 38 further comprises end sections 58. The end sections 58 are designed to exhibit a strong resistance to axial deformation at the interface or connection with flanges 50. End sections 58 may be formed by changing the proportion of swellable material 54 in layer 52 to a non-swelling material disposed against the axial interior of each flange 50. Other embodiments can utilize end sections 58 formed of inserted materials 60 embedded within an elastomer 62 to provide a strong material having resistance to axial deformation. Examples of inserted materials 60 comprise fibers, plastic inserts or metallic inserts embedded within the elastomer. End sections 58 help constrain swellable material 54 in a desired axial position between flanges 50 when swellable material 54 transitions from a contracted state, as illustrated in FIG. 2, to a swollen or expanded state, as illustrated in FIG. 3.

Figure 4:
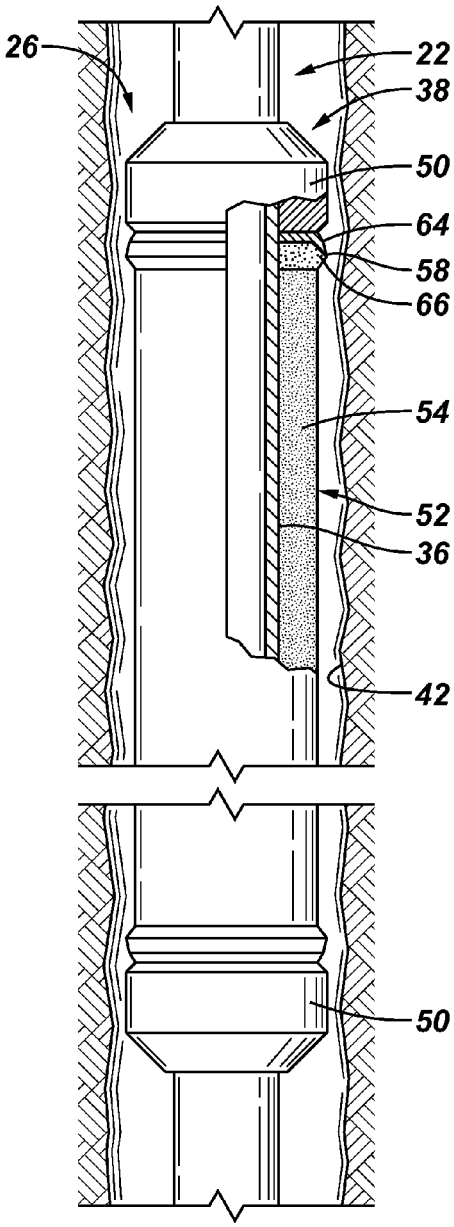
FIG. 4 is front elevation view of a packer having a swellable material, according to another embodiment of the present invention.
Figure 5:
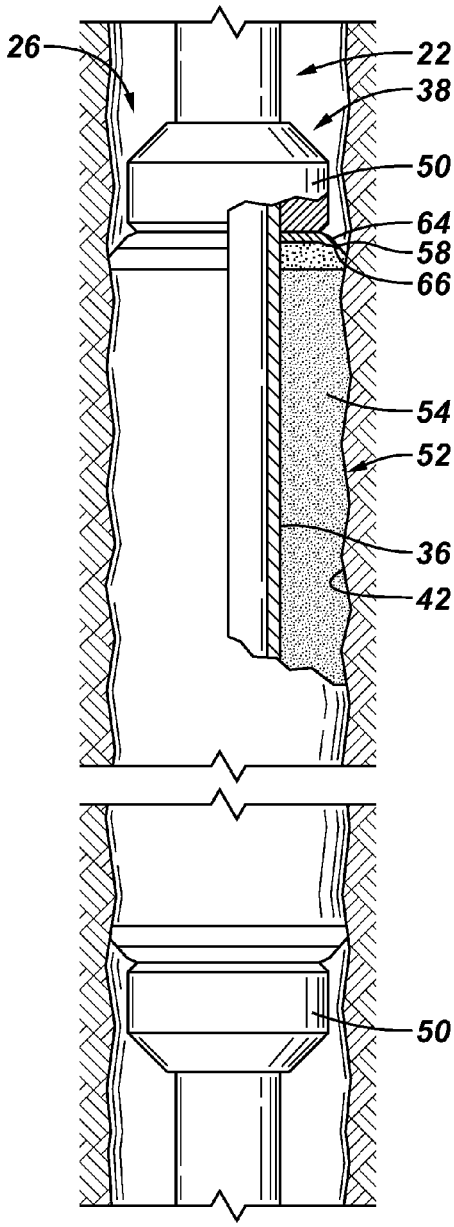
FIG. 5 is a view similar to that in FIG. 4, but showing the swellable material in an expanded or swollen state, according to an embodiment of the present invention.

An additional embodiment of end sections 58 is illustrated in FIGS. 4 and 5. In this embodiment, the resistance to axial deformation at the interface with flanges 50 is provided by cup assemblies, each having a cup-type insert 64. Cup inserts 64 can be made of, for example, reinforced polymer or a composition of metallic inserts and reinforced polymer. The cup-type inserts 64 provide axial resistance to axial expansion of layer 52 while deforming radially under the compressional action of layer 52. Additionally, the end sections 58 can include one or more radial layers 66 of elastomer, and each layer can be reinforced with an appropriate embedded reinforcement material, such as a fiber composition. The geometry and the composition of the cup inserts 64 and/or radial layers 66 provide radial compliance while resisting axial deformation of layer 52. As the packer 38 swells from a contracted state, as illustrated in FIG. 4, to an expanded state, as illustrated in FIG. 5, cup-type inserts 64 deform radially under the axial compressive loading, caused by swellable material 54, while resisting axial expansion.

Figure 6:
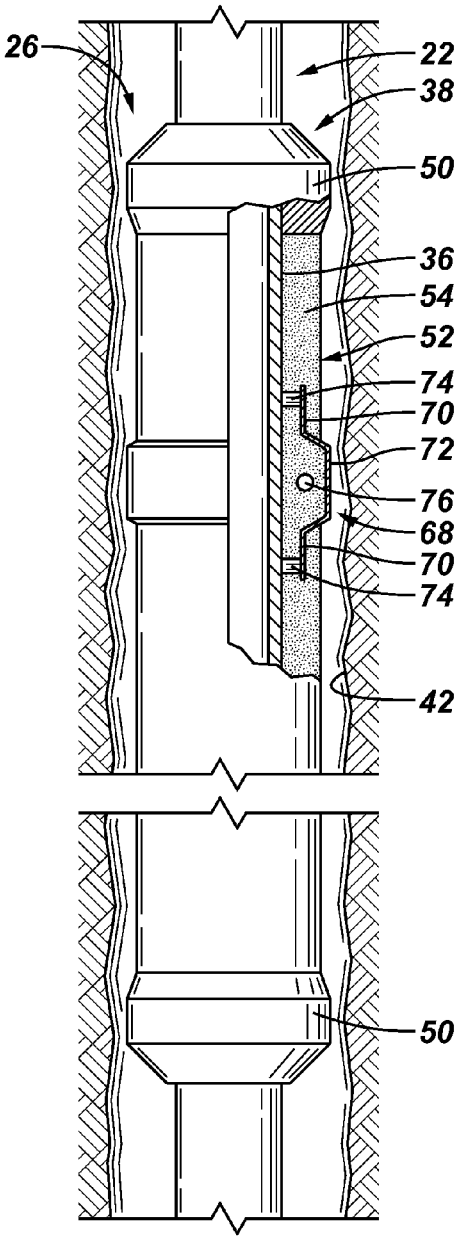
FIG. 6 is front elevation view of a packer having a swellable material, according to another embodiment of the present invention.
Figure 7:
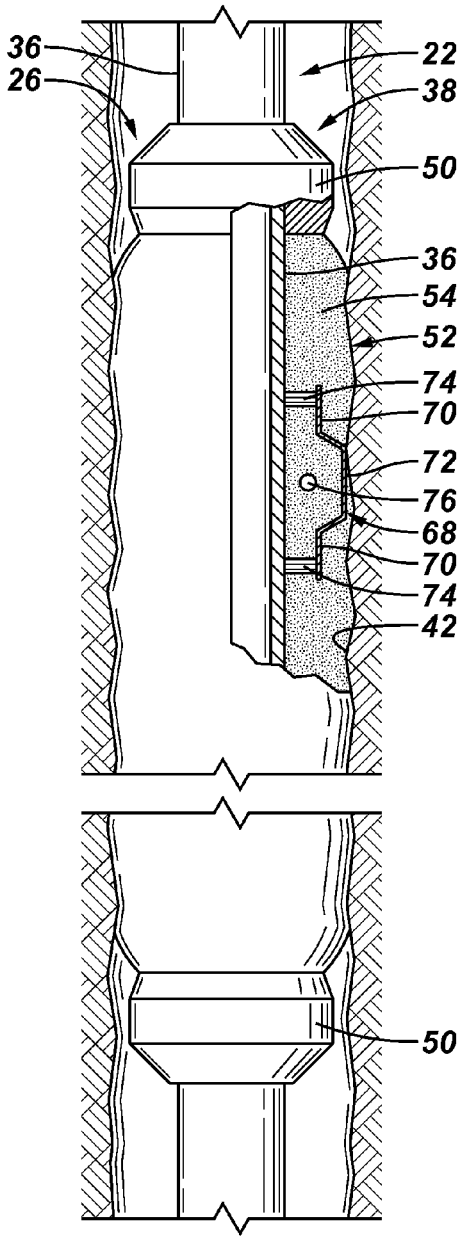
FIG. 7 is a view similar to that in FIG. 6, but showing the swellable material in an expanded or swollen state, according to an embodiment of the present invention.

Another embodiment of packer 38 is illustrated in FIGS. 6 and 7. In this embodiment, packer 38 further comprises a protective feature 68 designed to protect layer 52 of swellable material 54 during movement of packer 38 within wellbore 26. For example, protective feature 68 protects the swellable material during run-in of the completion 22 into wellbore 26. As illustrated, one or more protective features 68 may be located along layer 52 in a generally axially centralized position along the layer.

Each protective feature 68 is made from a relatively tough material. For example, the protective feature 68 may be formed from a relatively hard polymeric insert, a metallic insert or a combination of materials. Additionally, protective feature 68 may be at least partially embedded in layer 52, depending on the specific design objectives for the application. In the embodiment illustrated, for example, protective feature 68 comprises a plate having legs 70 and a displaced face portion 72. Legs 70 are embedded in layer 52, and face portion 72 is offset from legs 70 to an extent such that it lies along the periphery of layer 52 or protrudes from layer 52. Regardless of the specific design, the shape, size and material for protective feature 68 are selected to substantially avoid any interference with the radial expansion of packer 38, as it swells from the contracted state, as illustrated in FIG. 6, to the expanded or swollen state, as illustrated in FIG. 7.

In some embodiments, protective feature 68 may be secured to tubular 36 by, for example, appropriate fasteners 74 or other mechanisms suitable for creating the attachment. The protective feature 68 also may be used to protect one or more components 76 embedded in the swellable material 54 of layer 52. For example, a sensor element or other device can be embedded in swellable material 54 between tubular 36 and protective feature 68. Feature 68 provides protection for the component during movement within the wellbore and during expansion of packer 38.

In the embodiments described herein, swellable material 54 may be selected such that expansion or swelling of the material is induced by a specific substance or substances. For example, the material may be selected such that swelling is induced when exposed to a hydrocarbon fluid, such as oil; when exposed to water; or when exposed to another substance or substances that naturally occur downhole or that can be pumped downhole into contact with the one or more packers 38. The swellable material also can be a composite or hybrid material having portions that swell when exposed to different types of fluids. In some embodiments, the swellable material 54 is a swellable elastomer, however the specific type of swellable material or swellable elastomer may vary from one application to another. In the embodiments illustrated, for example, a swellable elastomer that swells in the presence of one of water, oil or another specific substance may be used. Examples of swellable materials are nitrile mixed with a salt or hydrogel, EPDM, or other swelling elastomers available to the petroleum production industry. In other embodiments, additional swellable materials such as super absorbent polyacrylamide or modified crosslinked poly(meth)acrylate can be used to form swellable layer 52.

Figure 8:
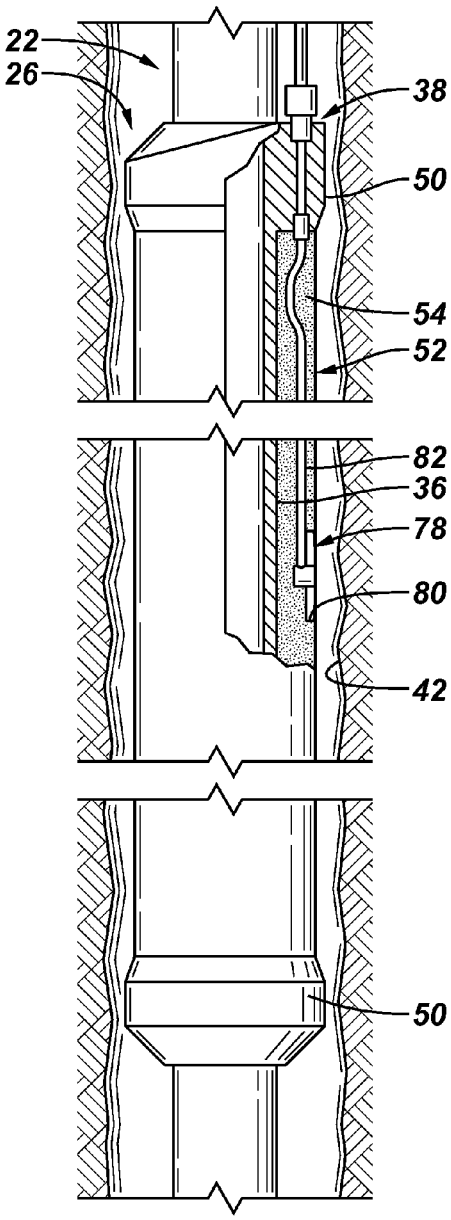
FIG. 8 is front elevation view of a packer having a swellable material, according to another embodiment of the present invention.
Figure 9:
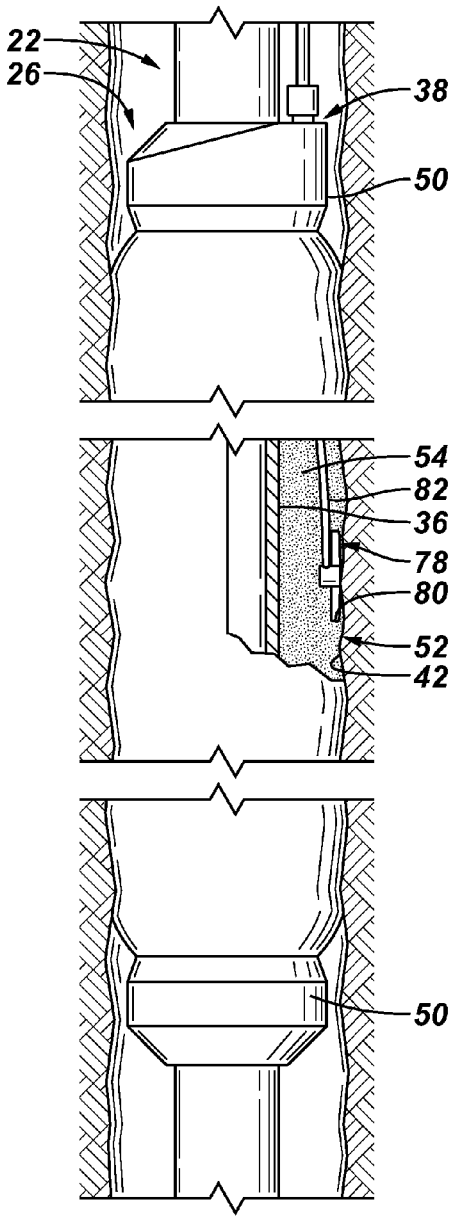
FIG. 9 is a view similar to that in FIG. 8, but showing the swellable material in an expanded or swollen state, according to an embodiment of the present invention.

In another embodiment, an individual or a plurality of probes 78 may be deployed in a corresponding region or regions 80 of layer 52, as illustrated in FIG. 8. For example, the one or more probes 78 may be at least partially embedded in the swellable material 54 of layer 52. In this example, each probe is positioned in layer 52 such that upon radial expansion of the layer, the probes 78 are pressed against the surrounding wall 42, e.g. the surrounding open wellbore wall or the interior of a surrounding casing or liner, as illustrated in FIG. 9. The probes 78 are designed to sense one or more well related parameters when pressed against surrounding wall 42. However, probes 78 also can be designed to sense well related parameters without contacting wall 42. By way of example, a given probe 78 may be a pressure sensing probe designed to measure formation pressure. In another example, probe 78 may be designed to test fluid samples within the formation or wellbore. These are just a few examples of the potential parameters that can be sensed by one or more probes 78.

Probes 78 can be coupled to other components located in the well to create of an overall measurement system. Additionally, data can be obtained from and/or sent to each probe 78 via an appropriate communication line 82, as illustrated in FIGS. 8 and 9. Communication line 82 can be, for example, an electrical line, a hydraulic line or a fiber optic line. One or more communication lines 82 also can be used for connection with other components or probes 78 located on, for example, the same packer 38, other packers along completion 22, and/or a wellbore liner or casing, e.g. casing 28.

Figure 10:
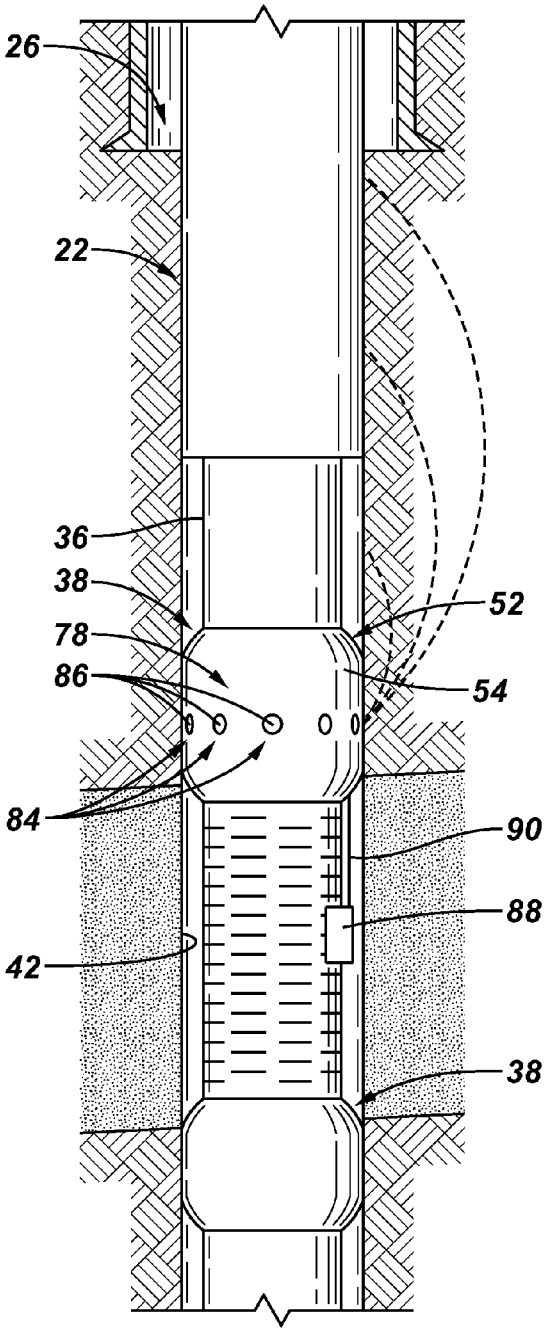
FIG. 10 is front elevation view of a packer having a swellable material, according to another embodiment of the present invention.
Figure 11:
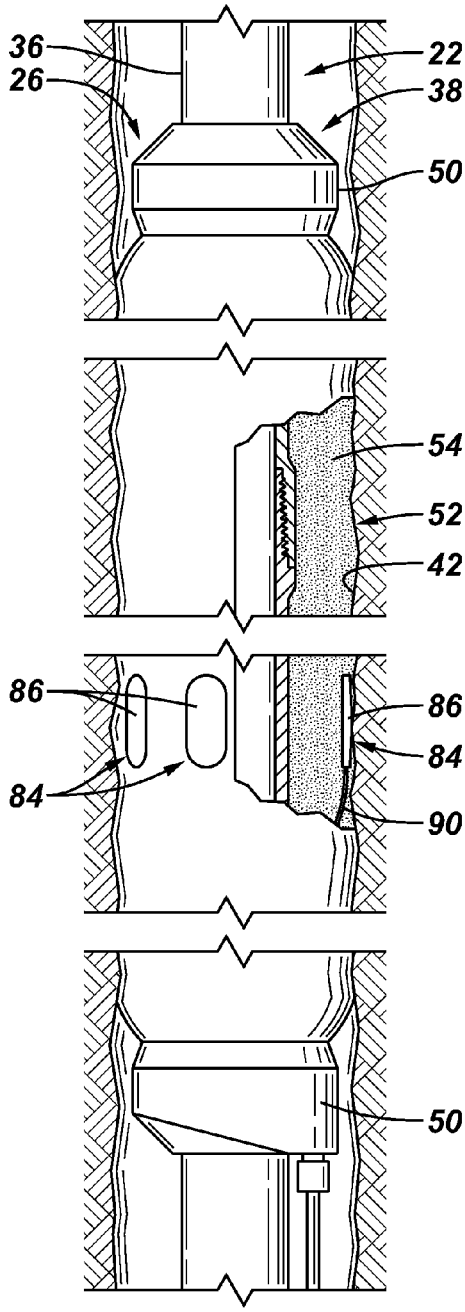
FIG. 11 is an enlarged view of the packer illustrated in FIG. 10, showing a partial cut-away portion, according to another embodiment of the present invention.

In other embodiments, probe 78 may comprise an electrode 84 deployed in swellable material 54 of layer 52, as illustrated in FIG. 10. For example, electrode 84 may be at least partly embedded in swellable material 54, such that the electrode is forced against the surrounding wall 42 upon radial expansion of packer 38, as illustrated in FIG. 11. In the specific embodiment illustrated, electrode 84 comprises a set of interconnected electrode elements 86 that act as one electrode substantially isolated from underlying and/or adjacent tubulars due to the electrical isolation provided by layer 52.

Electrode 84 may be utilized in a variety of well sensing procedures. For example, the electrode 84 may be utilized in electro-magnetic procedures, such as electromagnetic communication or VLF deep resistivity measurements. In one embodiment, electrode 84 comprises an electro-magnetic telemetry transmitting device able to feed an electrical current into the surrounding formation 34 to test properties of the formation, e.g. electrical resistivity. In other embodiments, electrode 84 serves as an electro-magnetic telemetry receiving device able to sense a variation of electrical potential. In still other embodiments, probe 78, via one or more electrode elements 86, can act concurrently as part of an electro-magnetic telemetry transmitting device and receiving device.

In these embodiments, packers 38 may be placed in an open hole or set in a tubular, such as a steel tubular. Location of the electrode 84 is selected according to desired electromagnetic propagation characteristics, and an electrical gap is achieved by virtue of a portion of the packer 38 and exposed electrode 84 facing the surrounding wall 42. Current is forced into the surrounding wall and formation 34 before it can return to the surrounding tubulars, thus enabling the desired well related measurements.

Again, probe 78, in the form of electrode 84, can be connected to other components 88, e.g. other probes 78, via appropriate communication lines 90. For example, the communication lines 90 can be used to connect the electrode to other components on the same packer, e.g. other electrodes located on the same packer. Additionally, the communication lines 90 can be used to couple electrode 84 to component locations, e.g. electrodes located on other packers or on other systems or completion equipment located in the well. The use of multiple probes at multiple locations provides a sensory array for measurement of well related parameters and communication of data.

Figure 12:
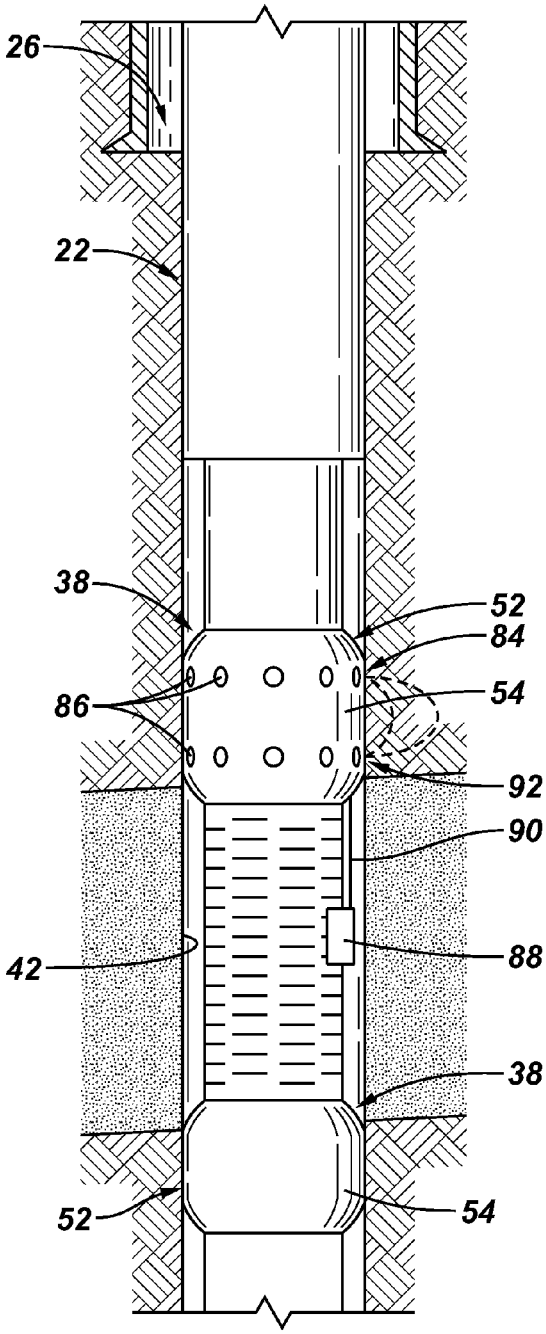
FIG. 12 is front elevation view of a packer having a swellable material, according to another embodiment of the present invention.
Figure 13:
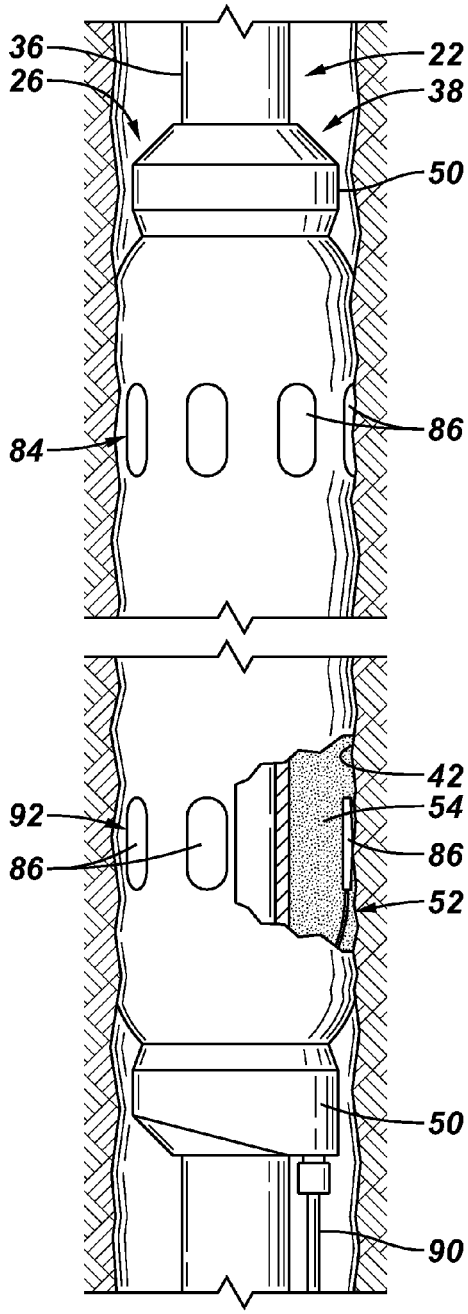
FIG. 13 is enlarged view of the packer illustrated in FIG. 12, showing a partial cut-away portion, according to another embodiment of the present invention.

In another embodiment, at least two electrodes, e.g. electrodes 84 and 92, are disposed in layer 52, as illustrated in FIG. 12. Electrodes 84 and 92 may be at least partly embedded in swellable material 54, such that the electrodes are forced against the surrounding wall 42 upon radial expansion of packer 38, as illustrated in FIG. 13. In the embodiment illustrated, each electrode 84 and 92 is formed by interconnected electrode elements 86. For example, specific electrode elements 86 cooperate to act as a single electrode, e.g. electrode 84, substantially isolated from underlying and/or adjacent tubulars due to the electrical isolation provided by layer 52. Similarly, the electrode elements of electrode 92 cooperate to act as a single electrode substantially isolated from underlying and/or adjacent tubulars. In the embodiment illustrated, each set of electrode elements 86 is placed generally in a circumferential row and interconnected. Thus, each row acts as a single circumferential electrode, one row being electrode 84 and the other electrode 92.

The combination of two electrodes 84 and 92 creates an electric dipole that is protected by the fluid present in the annulus or in the base tubular 36. Current is sent from one row to the other such that the portion of layer 52 disposed between circumferential rows of electrode elements 86 acts as an electrical gap. As with the embodiment illustrated in FIGS. 10 and 11, the electrical gap created by layer 52 is insensitive to the fluid present in the annuli. Depending on various electrical design parameters, the inner tubular 36 may be electrically continuous, or it may include an electrical gap.

A plurality of electrodes may be placed along the periphery of packer 38 to create various electrical spacing. Selecting difference spacings can be useful when, for example, a variety of electrical depths are to be investigated. In a more general approach, a plurality of packers 38 may be used to form an array of electrodes along a relatively large distance.

Similar to the description of the embodiment utilizing a single electrode 84, electrodes 84 and 92 also can be connected to other components 88, e.g. other probes 78, via appropriate communication lines 90. The electrodes 84 and 92 can be connected to other components on the same packer, such as other electrodes located on the same packer. Additionally, communication lines 90 can be used to couple electrodes 84 and 92 to components, including other electrodes, on other packers, systems or completion equipment located in the well.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system, comprising:

a completion deployable in a wellbore, the completion comprising:

a tubular;

a pair of flanges secured to the tubular;

a layer of swellable elastomer disposed around the tubular and axially constrained between the pair of flanges; and a pair of end sections disposed on axially opposite ends of the layer of swelling elastomer to provide resistance to axial deformation at each interface with the pair of flanges, the pair of end sections comprising radially extending layers of reinforced elastomer.

2. The system as recited in claim 1, wherein the pair of end sections comprises a non-swelling elastomer disposed adjacent the pair of flanges.

3. The system as recited in claim 1, wherein the pair of end sections comprises a non-swelling composite material disposed adjacent the pair of flanges.

4. The system as recited in claim 1, wherein the pair of end sections comprises a pair of relatively hard cup assemblies.

5. The system as recited in claim 1, wherein the pair of flanges comprises a plurality of pairs, and the layer of swellable elastomer comprises a plurality of layers, each layer being disposed around the tubular and axially constrained between corresponding pairs of flanges.

6. A system, comprising:

a completion for deployment in a wellbore, the completion having a tubular and a packer surrounding the tubular, the packer comprising:

a layer of swellable material disposed around the tubular, wherein exposure to a specific substance induces swelling of the swellable material; and a protective feature coupled to the layer between axial ends of the layer to protect the swellable material during movement through the wellbore.

7. The system as recited in claim 6, further comprising a pair of flanges secured to the tubular, the layer being axially constrained between the pair of flanges.

8. The system as recited in claim 6, wherein the swellable material comprises a swellable elastomer.

9. The system as recited in claim 6, wherein the protective feature is at least partly embedded in the layer.

10. The system as recited in claim 6, wherein the protective feature compnses a metallic insert.

11. The system as recited in claim 6, wherein the protective feature comprises a reinforced polymeric insert.

12. The system as recited in claim 6, wherein the packer comprises a component embedded in the layer and protected by the protective feature.

13. A system, comprising:

a completion for deployment in a welibore, the completion having:

a tubular;

a packer with a layer of swellable material disposed around the tubular; and a probe at least partly embedded in the layer such that a portion of the probe is exposed through the swellable material to sense a well related parameter.

14. The system as recited in claim 13, wherein the swellable material comprises a swellable elastomer that swells upon exposure to a specific substance.

15. The system as recited in claim 14, wherein the probe is disposed to contact a surrounding wall upon expansion of the layer of swellable material.

16. The system as recited in claim 15, wherein the probe comprises a pressure sensor.

17. The system as recited in claim 15, wherein the probe is designed to test fluid samples.

18. The system as recited in claim 15, wherein the probe comprises an electrode for use in electro-magnetic procedures.

19. The system as recited in claim 18, wherein the probe comprises an electro-magnetic telemetry transmitting device.

20. The system as recited in claim 18, wherein the probe comprises an electro-magnetic telemetry receiving device.

21. The system as recited in claim 18, wherein the electrode comprises a plurality of electrodes.

22. The system as recited in claim 15, wherein the probe comprises an electrical resistivity sensor.

23. The system as recited in claim 15, wherein the probe comprises groups of the electrode elements acting as two electrodes isolated by a portion of the packer to create an electric dipole.

24. The system as recited in claim 13, wherein the packer comprises a plurality of packers.

* * * * *